United States Patent [19]

Moynihan, III

[11] Patent Number: 4,923,392

[45] Date of Patent: May 8, 1990

[54] COMBINATION BEVERAGE OPENER AND LIGHTER HOLDER

[76] Inventor: John L. Moynihan, III, 2748 NE. 15th St., Fort Lauderdale, Fla. 33304

[21] Appl. No.: 419,130

[22] Filed: Oct. 10, 1989

[51] Int. Cl.[5] ..... B67B 7/44

[52] U.S. Cl. ..... 431/253; 7/151; 7/167; 81/3.09; 81/3.55

[58] Field of Search ..... 81/3.09, 3.55; 7/151, 7/167; 431/253

[56] References Cited

U.S. PATENT DOCUMENTS

| | | | |
|---|---|---|---|
| 2,611,178 | 9/1952 | Whipple et al. | 7/167 |
| 4,361,920 | 12/1982 | Zanni | 7/151 |
| 4,373,223 | 2/1983 | Miller | 7/151 |
| 4,560,344 | 12/1985 | Kietaibl | 7/151 |
| 4,569,653 | 12/1986 | Becker et al. | 7/151 |
| 4,625,861 | 12/1986 | Krog | 7/151 |
| 4,642,827 | 2/1987 | Karuzas | 7/151 |
| 4,723,465 | 2/1988 | Hughes | 81/3.09 |
| 4,846,024 | 7/1989 | Bryant et al. | 81/3.55 |
| 4,854,856 | 8/1989 | Steiger et al. | 431/253 |

*Primary Examiner*—Roscoe V. Parker
*Attorney, Agent, or Firm*—Alvin S. Blum

[57] ABSTRACT

A combination lighter case and opener for both crown cap bottles and tab top cans has a handle with recess for removably holding a cigarette lighter. The lighter operating elements are exposed at one end of the handle. Another end of the handle is provided with a loop type opener for prying off crown caps. Extending from the end of the loop type opener is a projection for sliding under the tab of a tab top can. A recess at the base of the projection engages the tab for bending it down after the can is opened.

7 Claims, 1 Drawing Sheet

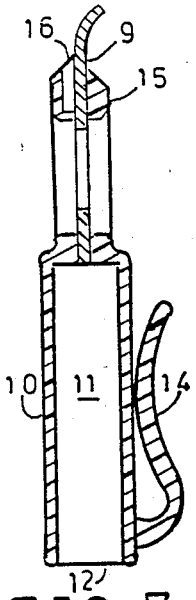
FIG. 7
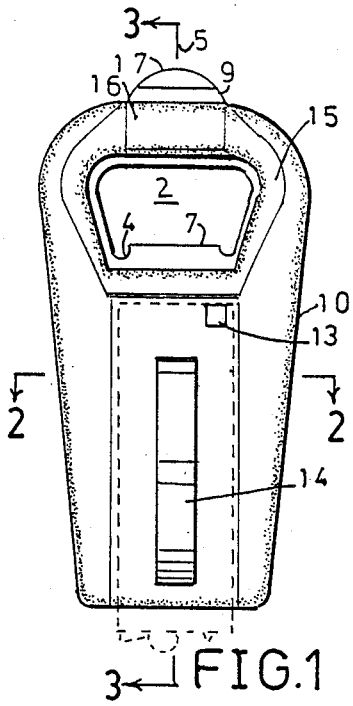
FIG. 1
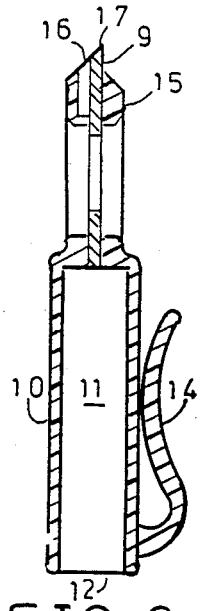
FIG. 3
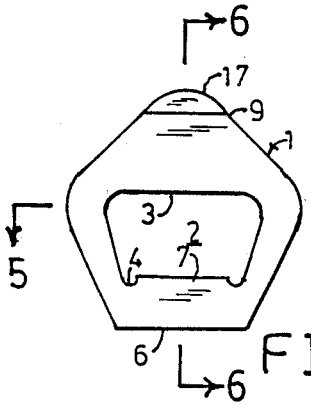
FIG. 4
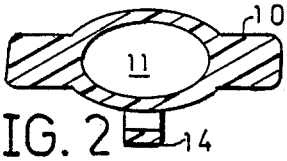
FIG. 2
FIG. 5
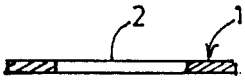
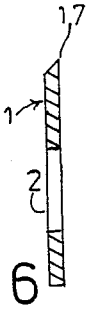
FIG. 6

COMBINATION BEVERAGE OPENER AND LIGHTER HOLDER

BACKGROUND OF THE INVENTION

This invention relates to openers for beverage containers and more particularly to an opener for both crown caps and tab-top cans in combination with a holder for a cigarette lighter.

Various designs for bottle openers adapted to open crown caps are known, having evolved with the crown cap industry. They have combined with other items for convenience. The combination of a crown cap bottle opener with an internal hollow chamber for removably containing a disposable lighter is disclosed in U.S. Pat. No. 4,642,827 issued 2/17/87 to Karuzas. It employs an oval tubular body with a shaped notch for engaging the crown cap. Karuzas provides a review of related patents including U.S. Pat. No. 4,361,920 issued 12/7/82 to Zanni and U.S. Pat. No. 4,373,223 issued 2/15/83 to Miller. In addition, U.S. Pat. No. 4,569,653 issued 2/11/86 to Becker and U.S. Pat. No. 4,560,344 issued 12/24/85 to Kietaibl disclose a lighter with hook attached for bottle cap opening. Although the art of combination openers and lighters is crowded, there is not available a device that combines a lighter holder with a crown cap opener that is fast and easy to use and that will also open tab top cans with an easy motion. Such devices will find favor with volume users such as bartenders only if they are easy to operate, durable, and inexpensive. Crown cap openers are of two general types. The hook type has a notch above a hook that bends up the side of the cap and requires considerable force. The loop type has a large aperture at the end of a handle. The side of the aperture nearest the handle has a flat projection that fits under the edge of the cap. The side of the aperture farthest from the handle rests upon the farther side of the cap and acts as a fulcrum when the handle is raised. This type is much easier to use. Although tab-top cans are made for opening without tools, this only applies to occasional use. A bartender needs a device that has a flat, small tongue that will slide easily beneath the tab and a means of engaging the tab after it is lifted by the tongue to lower it again after the can is opened.

SUMMARY OF THE INVENTION

It is accordingly an object of the invention to provide a device that will removably contain a cigarette lighter in combination with a crown cap opener and a tab-top can opener that is inexpensive to manufacture, durable, and easy to operate.

It is yet another object that the device be small and convenient to carry when not in use by being small enough to fit comfortably in a pocket with a spring clip to hold to the pocket so that it is readily accessed.

In accordance with the present invention, a combined beverage opener and lighter holder comprises an elongated body which serves as a handle for the beverage opener functions. The body has an internal hollow chamber with an opening at one end for removably receiving a lighter into the chamber. Disposable cigarette lighters of the type using a gas fuel have been found useful for this purpose. The chamber is so configured that the operating elements of the lighter extend from the body and the remainder of the lighter is enclosed by the body to form a large handle for the lighter. At the end of the body opposite the opening in the chamber, both the crown cap and tab-top openers are located. The crown cap opener is of the loop type with a first element at the proximal edge of the loop being thin enough to fit easily beneath the lower edge of the crown without interference from the neck of the bottle and the distal edge of the loop adapted to rest on the far side of the cap to serve as a fulcrum as the first element is lifted by the handle. Extending beyond the loop is a second thin element adapted to slide beneath the tab on a can along with a recess for receiving the tab during the process of opening a tab-top can.

These and other objects, features and advantages of the present invention will become more apparent from the detailed description of the embodimentss when read in conjunction with the appended drawings.

BRIEF DESCRIPTION OF THE DRAWINGS

FIG. 1 is a front elevation view of the invention with a lighter shown in phantom.

FIG. 2 is a sectional view taken through line 2—2 of FIG. 1.

FIG. 3 is a sectional view taken through line 3—3 of FIG. 1.

FIG. 4 is a front elevation view of the metal member that is a component of the device of FIG. 1.

FIG. 5 is a sectional view taken through line 5—5 of FIG. 4.

FIG. 6 is a sectional view taken through line 6—6 of FIG. 4.

FIG. 7 is a partial sectional view corresponding to FIG. 3 of an alternative embodiment with a bent tab-engaging member.

DETAILED DESCRIPTION OF PREFERRED EMBODIMENTS

Referring now first to FIGS. 4, 5 and 6, a thin metal plate 1 of a rigid material such as steel is provided with a large central aperture 2. Aperture 2 has two opposed inner edges 3 and 4 disposed transversely to the long axis 5 of the device. The first inner edge 3 is adapted to rest upon the top of a crown cap to serve as a fulcrum when the second inner edge 4 is fitted beneath the side of the crown cap and lifted up to dislodge the cap from a bottle. The aperture 2 is large enough that the edge 3 rests upon the cap at a point far from the side engaged by edge 4. It is preferred that this distance be at least halfway across the cap to apply more of a lifting force. This action requires less effort than those openers that operate on only one side of the cap by prying the cap away from the bottle. Such devices also may require a hook edge to prevent slipping.

By using the loop type or large aperture, less side force and less leverage is required, so that the device may be provided with a shorter handle at handle end 6 for a more compact, yet effective design.

Edge 4 may be provided with a projection such as 7 for more easily fitting beneath the edge of the crown cap. By providing a rigid metal plate, the edge 4 and/or projection 7 may be made thin enough to readily fit beneath the edge of the crown can with less interference from the adjacent glass bottle. The end of metal plate 1 opposite the handle end 6 extends in a narrowed tip 9 that is small enough to easily slide beneath the tab of a tab-top can. The tip may have a bevel 17 at its outer edge for easier insertion beneath the tab.

Alternatively, as shown in FIG. 7, the tip may be of uniform thickness and bent down for easier insertion.

Referring now to FIGS. 1–3, the device of the invention is shown in its entirety. The metal plate 1 is contained within a plastic body 10 that formss a handle for both the crown cap and tab-top opener. An elongate chamber 11 is formed in the body. The chamber has an opening 12 at one end for inserting and removing a lighter. A lighter, shown in phantom in FIG. 1 fits within the chamber with its operation end extending beyond the end 12 of the chamber so that the lighter may be operated without removal from the chamber. The chamber is arranged for a snug fit of the lighter and a hole 13 in the body may be provided for pushing the lighter out when its fuel is exhausted. The body may be formed of a transparent plastic for displaying advertising indicia on the lighter. Advertising indicia (not shown) may be provided on the body by means well known in the art. A spring clip 14 may be provided for engaging the edge of clothing such as a pocket for convenience in carrying and to provide ready access since the entire device is very small.

As is more easily seen in FIG. 3, the plastic body 10 forms a collar 15 around the outer edge of plate 1 to hold it firmly in place and tip 9 extends beyond that plastic collar to form an element thin enough to slip beneath a tab. A slot or recess 16 is molded into the plastic just above the base of tip 9. This recess is adapted to receive the end of the tab so that it can be lowered after it is raised by tip 9. It is preferred to first raise the tab to open the can and then lower the tab so that it doesn't interfere with drinking from the can. The tip 9 also serves as a tool for removing wrappers on wine bottles and for prying the wires off champagne corks.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. A combination case for a lighter and opener for both bottles with crown caps and cans with tab tops, comprising:

(a) an elongate body that serves as a handle;

(b) an internal hollow chamber within said body, said chamber having an open end at a first end of said body, wherein said chamber is arranged to removably receive the body of said lighter to serve as an outer case;

(c) a crown opener element extending from a second end of said body, said crown opener element having an aperture with proximal and distal inner edges arranged transverse to the long axis of said body, said proximal edge arranged for fitting under the edge of said crown cap and said distal edge arranged to serve as a fulcrum for resting upon the top of said crown cap while said proximal edge pries the cap upward;

(d) a thin and narrow projection extending from the terminal end of said crown opener element, wherein said projection is arranged to fit beneath the tab of said tab-top can for prying it upward to open said can, said projection also serving as a tool for removing wrappers and wires from bottles; and (e) a tab receiving recess located at the base of said projection for receiving said tab, said recess serving to engage said tab for bending it down after it has been raised, said body is made substantially of plastic and said plastic is transparent.

2. The case and opener according to claim 1, further comprising a pocket clip attached to said body for convenience in carrying.

3. A combination case for a lighter and opener for both bottles with crown caps and cans with tab tops, comprising:

(a) a thin, rigid, flat, metal plate having a large aperture;

(b) a pair of opposed inner edges of said aperture comprising a fulcrum edge and a crown-engaging edge in which said crown engaging edge is arranged to fit beneath the lower margin of said crown cap and said fulcrum edge is arranged to rest upon the surface of said crown cap on the side remote from the point of engagement of said margin to serve as a fulcrum for prying off said crown cap;

(c) a narrow projection of said plate extending from a first outer edge of said plate, wherein said projection is arranged to fit beneath the tab of said tab-top can for prying it upward to open, said can, said projection also serving as a tool for removing wrappers and wires from bottles;

(d) an elongate handle means connected to said plate and extending from said plate in a direction away from said projection to provide a handle for leverage in operating said opener; and (e) an internal hollow chamber means within said handle means, said chamber means having an open end remote from said plate, wherein said chamber is arranged to removably receive the body of said lighter to serve as an outer case and handle; and (f) a recess at the base of said projection for receiving said tab, said recess serving to engage said tab for bending it down after it has been pried upward, a plastic material forms said handle means and extends in a rim around said plate with said projection extending beyond said rim and said recess is formed in said rim.

4. The case and holder according to claim 3, in which said plastic is transparent to provide visibility of indicia on said lighter.

5. The case and holder according to claim 3, further comprising a pocket clip connected to said handle means.

6. The case and holder according to claim 3, in which said projection is provided with a tapered end for enhanced insertion beneath said tab.

7. The case and holder according to claim 3, in which said projection is provided with a bent end for enhanced insertion beneath said tab.

* * * * *